US011143994B2

(12) United States Patent
Okanemasa

(10) Patent No.: US 11,143,994 B2
(45) Date of Patent: Oct. 12, 2021

(54) IMAGE HEATING APPARATUS

(71) Applicant: CANON KABUSHIKI KAISHA, Tokyo (JP)

(72) Inventor: Tempei Okanemasa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/847,991

(22) Filed: Apr. 14, 2020

(65) Prior Publication Data

US 2020/0333735 A1 Oct. 22, 2020

(30) Foreign Application Priority Data

Apr. 17, 2019 (JP) ..... JP2019-078736

(51) Int. Cl.
*G03G 15/20* (2006.01)

(52) U.S. Cl.
CPC ..... *G03G 15/2053* (2013.01); *G03G 15/2064* (2013.01); *G03G 2215/2025* (2013.01)

(58) Field of Classification Search
CPC ..... G03G 15/2053; G03G 15/2064; G03G 2215/2025; G03G 2215/2029; H05B 1/241; H05B 3/066
See application file for complete search history.

(56) References Cited

U.S. PATENT DOCUMENTS

| | | | | |
|---|---|---|---|---|
| 10,120,307 | B2 | 11/2018 | Okanemasa | |
| 10,295,940 | B2 | 5/2019 | Okanemasa | |
| 2013/0336672 | A1* | 12/2013 | Mizuta | G03G 15/2053 399/75 |
| 2014/0105633 | A1* | 4/2014 | Takahashi | G03G 15/206 399/90 |
| 2014/0105634 | A1* | 4/2014 | Tanaka | G03G 15/2042 399/90 |
| 2015/0277309 | A1* | 10/2015 | Kuroda | G03G 15/2053 219/541 |
| 2019/0339638 | A1* | 11/2019 | Kinukawa | G03G 15/2053 |
| 2020/0103814 | A1* | 4/2020 | Someya | G03G 15/2064 |

FOREIGN PATENT DOCUMENTS

JP 2014-081524 A 5/2014

* cited by examiner

*Primary Examiner* — Francis C Gray
(74) *Attorney, Agent, or Firm* — Venable LLP

(57) ABSTRACT

An image heating apparatus includes a rotatable endless belt; a rotatable member, a plate-like heater, a holding member, a connector, movable in a first direction and a fixing member. The fixing member is mountable to and dismountable from the connector and the holding member by being moved in a second direction different from the first direction. The fixing member is mountable after the connector is mounted to the heater and the holding member, and the connector is dismountable after the fixing member is dismounted from the holding member.

11 Claims, 11 Drawing Sheets

(a)

(b)

(a)

(b)

(a)

(b)

(a)

(b)

IMAGE HEATING APPARATUS

FIELD OF THE INVENTION AND RELATED ART

The present invention relates to an image heating apparatus as a fixing device for use with an image forming apparatus of an electrophotographic type or an electrostatic recording type.

Conventionally, in the fixing device (image heating apparatus) for use with the image forming apparatus of the electrophotographic type, a fixing device including an endless fixing belt as a heating member and a roller opposing the fixing belt and press-contacted to the fixing belt becomes widespread. The fixing belt is rotatably supported by a substantially cylindrical support member at both end portions thereof with respect to a rotation axis direction, and forms a nip for a recording material between itself and the roller, and is driven and circulated by drive of the roller. As such a fixing device, a fixing device in which a heating member on which a resistance heating pattern is formed is contacted to an inner surface of the fixing belt and an image surface of the recording material passing through the nip is heated through the fixing belt has been known (Japanese Laid-Open Patent Application (JP-A) 2014-81524).

In this fixing device, in order to supply a current to be heating member, end portions, with respect to a rotation axis direction, of the heating member and a guiding member for guiding the fixing belt on an inner peripheral surface side of the fixing belt are provided so as to project outward from a supporting member. Further, to the end portions of the heating member and the guiding member which are projected to the outside of the supporting member, a connector connectable to a voltage (power) source is mounted, so that the current is supplied to the heating member. Further, in this fixing device, in order to retain the connector mounted to the heating member and the guiding member, a locking claw of the connector and a projection of the supporting member are locked to each other.

In the above-described fixing device disclosed in JP-A 2014-81524, when the fixing belt and the roller are press-contacted to each other, the guiding member and the heating member are elastically deformed by receiving a force in a press-contact direction in some cases. In this case, the connector mounted to the end portions displaces in the press-contact direction relative to the supporting member in some instances. Thus, in the fixing device disclosed in JP-A 2014-81524, in the case where the guiding member and the heating member are elastically deformed in the press-contact direction, the connector displaces in the press-contact direction, so that there is a liability that the engagement between the locking claw of the connector and the projection of the supporting member is released (eliminated). When the engagement between the locking claw of the connector and the projection of the supporting member is released, in the case where an unexpected force acts on the connector in this state, the connector moves in an extraction direction relative to the guiding member and the heating member, so that there is a liability of an occurrence of improper energization to the heating member.

SUMMARY OF THE INVENTION

A principal object of the present invention is to provide a fixing device (image heating apparatus) capable of retaining a connector.

According to an aspect of the present invention, there is provided an image heating apparatus for heating an image on a recording material, comprising: a rotatable endless belt; a rotatable member configured to form a nip, between itself and the belt, in which the recording material on which a toner image is carried is nipped and fed; a plate-like heater provided on an inner peripheral side of the belt and configured to heat the belt; a holding member configured to hold the heater; a connector mounted to end portions of the heater and the holding member and capable of supplying a current to the heater, the connector being mountable to and dismountable from the heater and the holding member by being moved in a first direction; and a fixing member provided in engagement with the connector and the holding member and configured to prevent the connector from being dismounted from the heater and the holding member, wherein the fixing member is mountable to and dismountable from the connector and the holding member by being moved in a second direction different from the first direction, and wherein the fixing member is mountable after the connector is mounted to the heater and the holding member, and the connector is dismountable after the fixing member is dismounted from the holding member.

Further features of the present invention will become apparent from the following description of exemplary embodiments with reference to the attached drawings.

Figure 3:
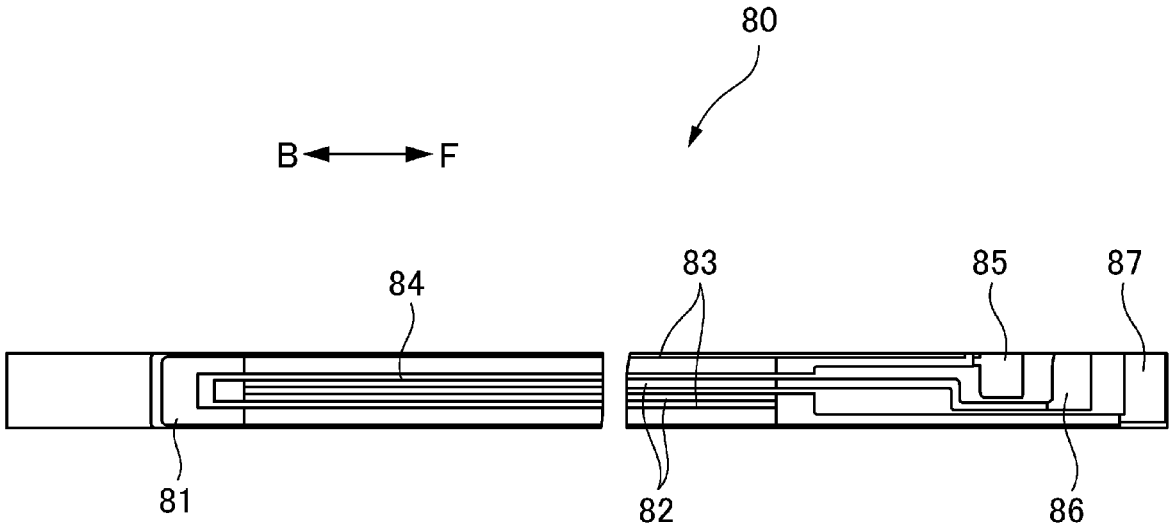
Figure 3:
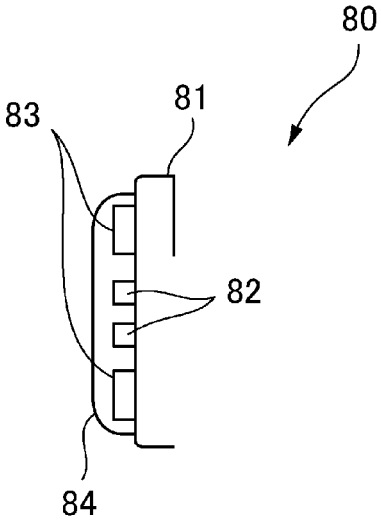

Parts (a) and (b) of FIG. 3 are schematic views showing a ceramic heater in the first embodiment, in which part (a) is a bottom view of the ceramic heater and part (b) is a sectional view of the ceramic heater.

Figure 4:
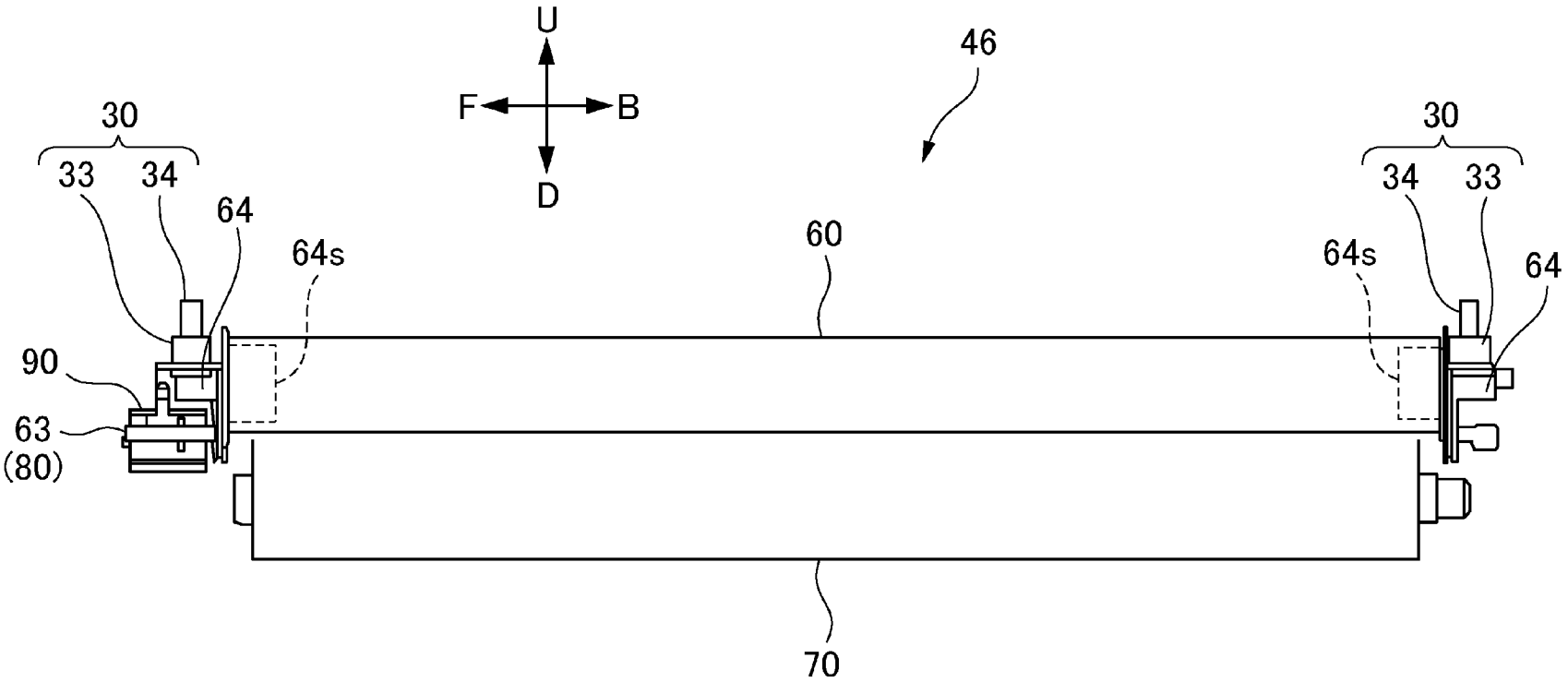

FIG. 4 is a side view showing a state in which a fixing member is not mounted in the fixing device according to the first embodiment.

Figure 5:
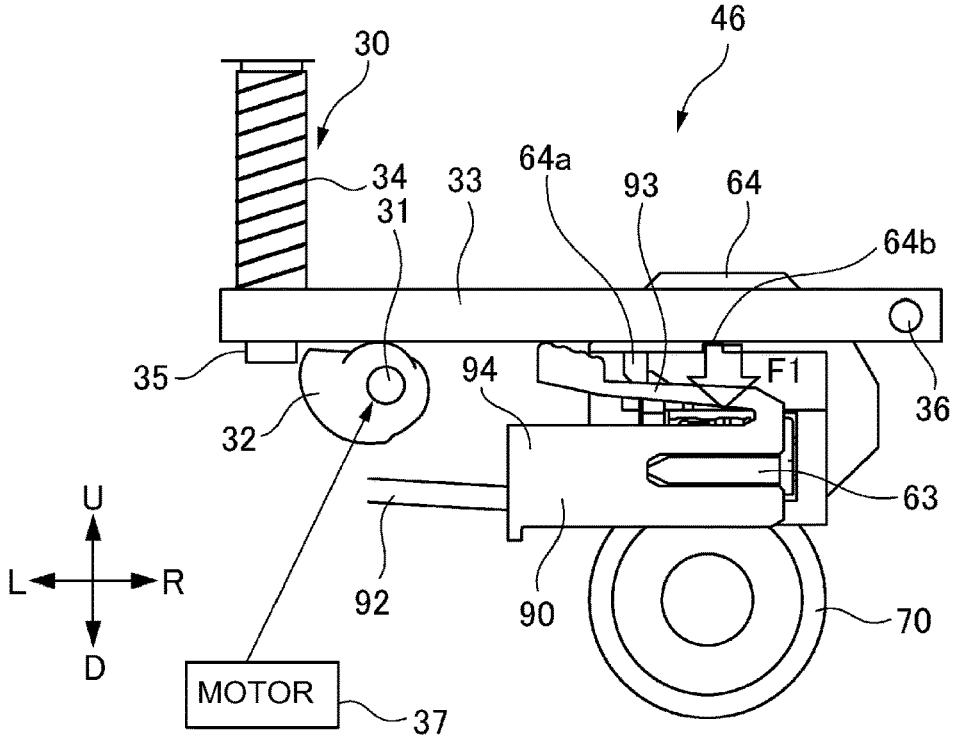
Figure 5:
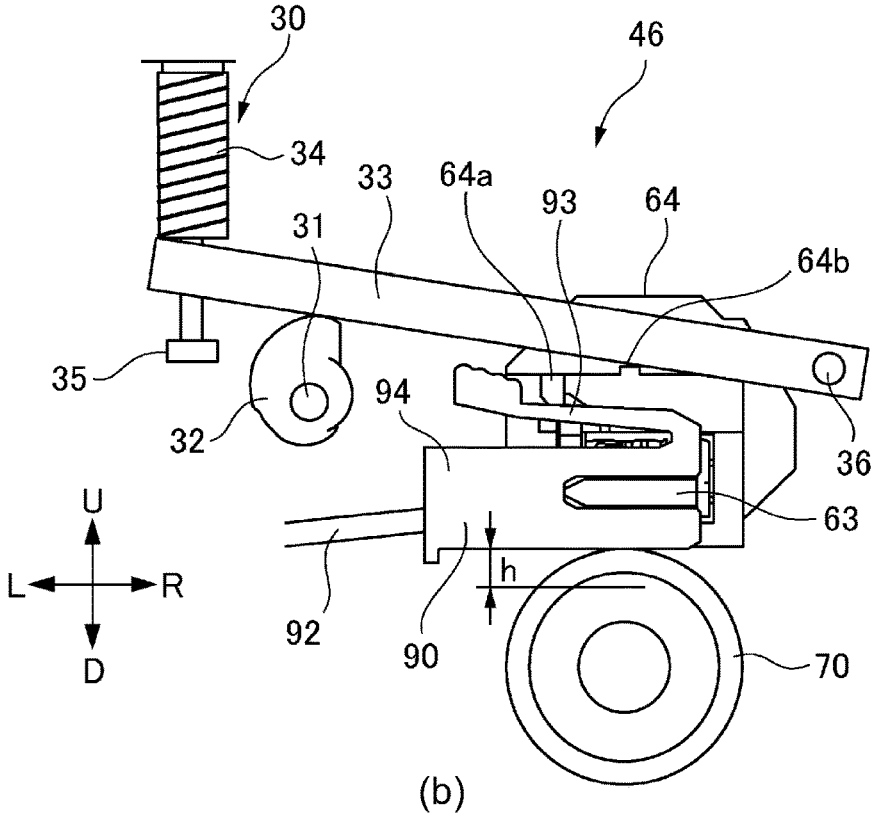

Parts (a) and (b) of FIG. 5 are front views showing the state in which the fixing member is not mounted in the fixing device according to the first embodiment, in which part (a) shows a pressed state and part (b) shows a pressure-released state.

Figure 6:
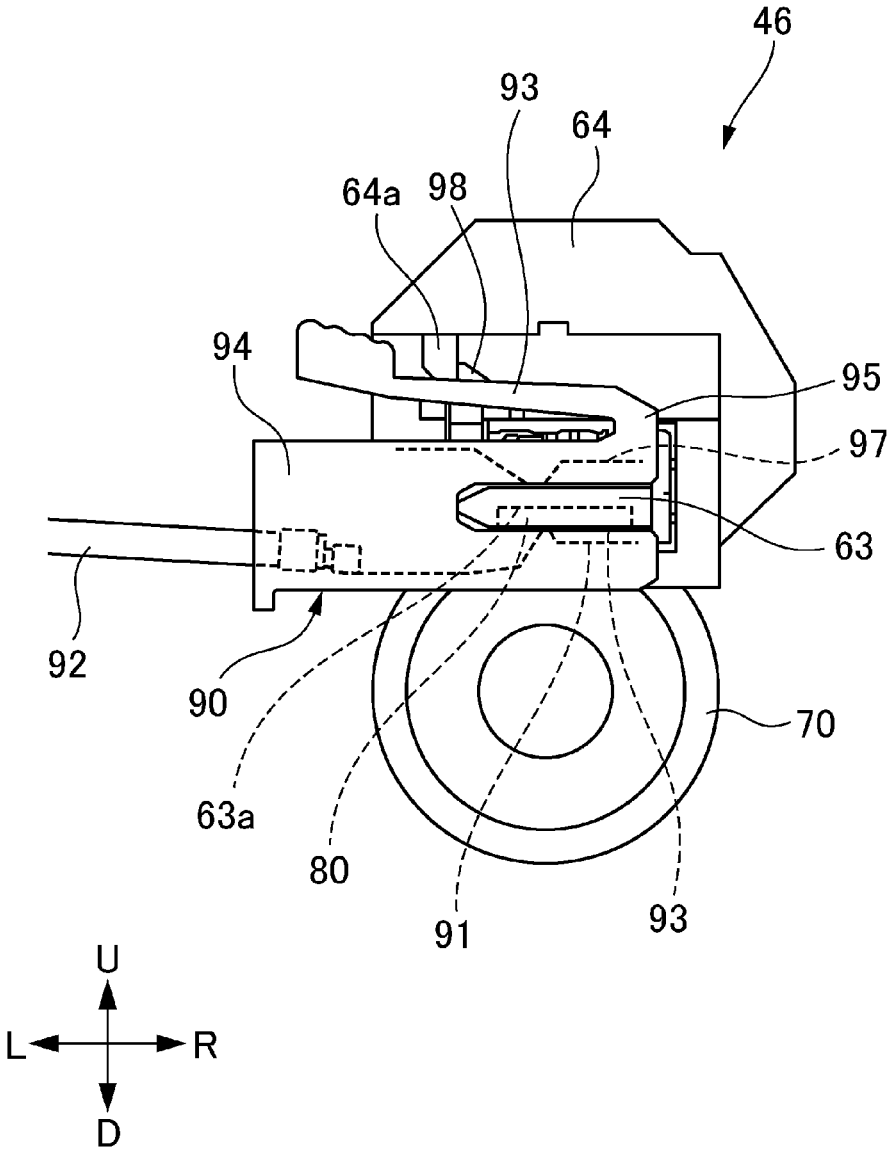

FIG. 6 is a front view showing the state in which the fixing member is not mounted in the fixing device according to the first embodiment.

Figure 7:
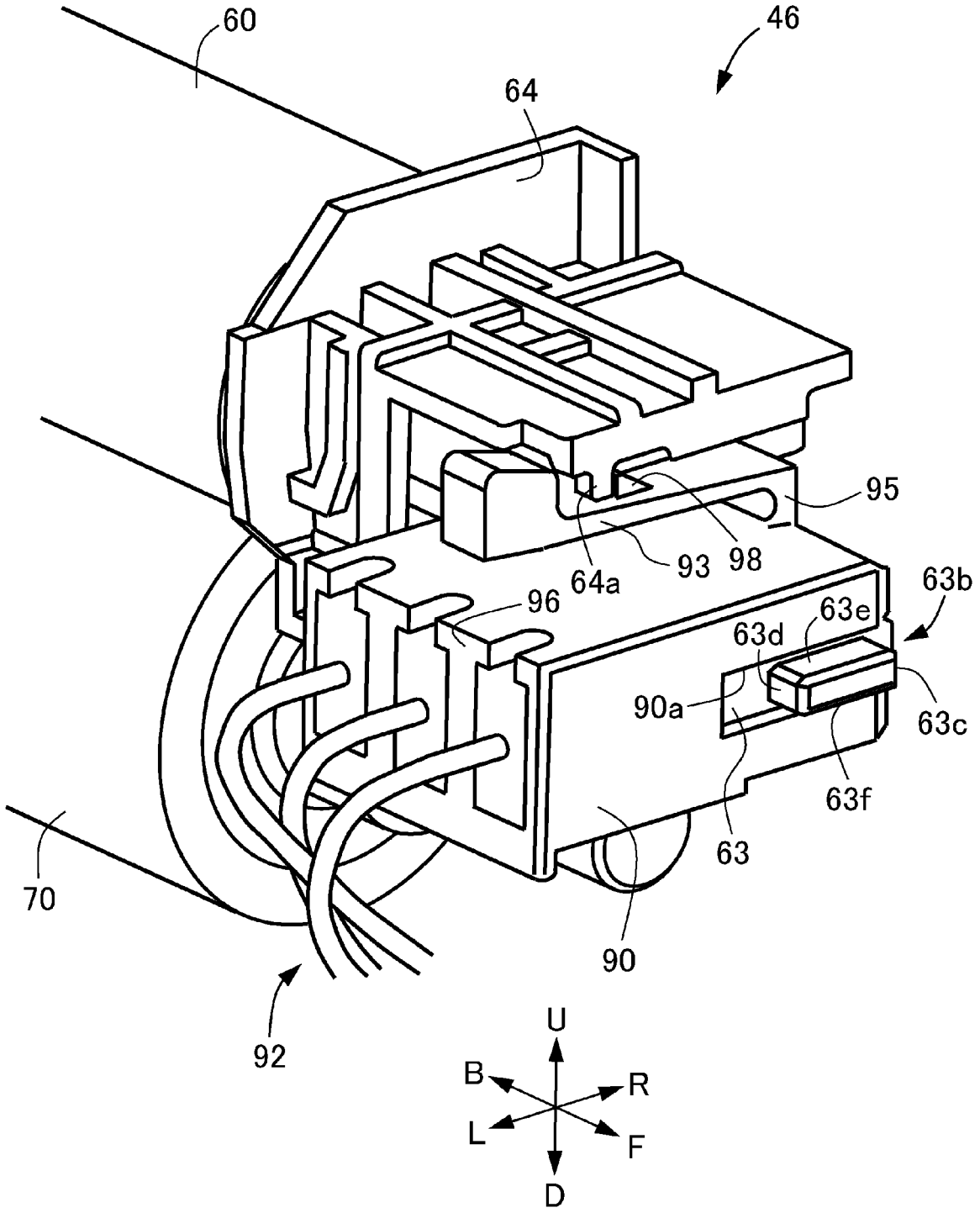

FIG. 7 is a perspective view showing the state in which the fixing member is not mounted in the fixing device according to the first embodiment.

Figure 8:
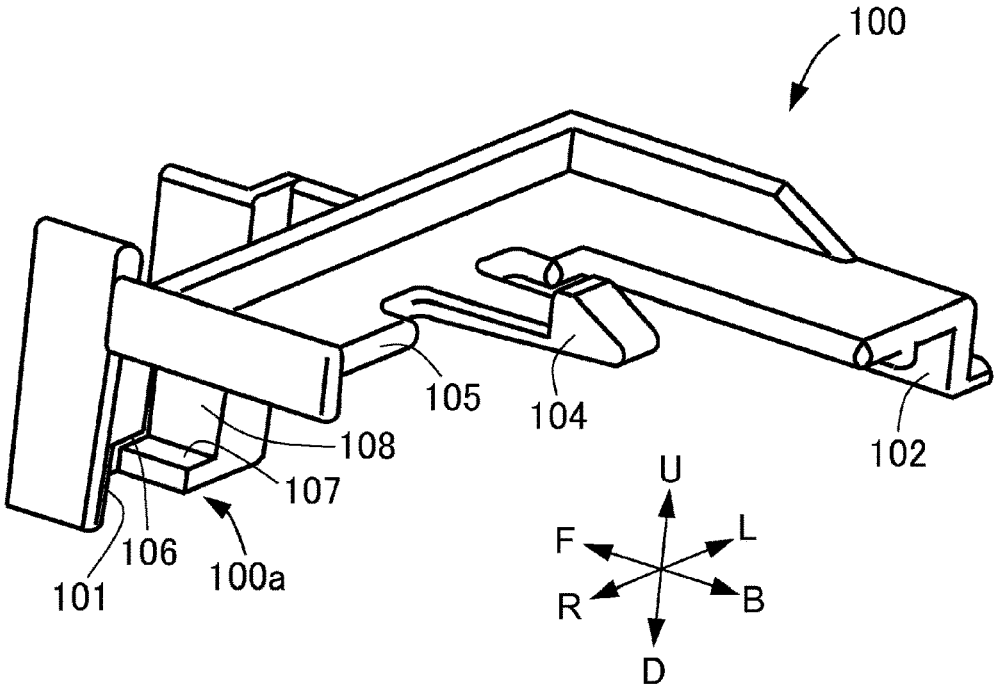
Figure 8:
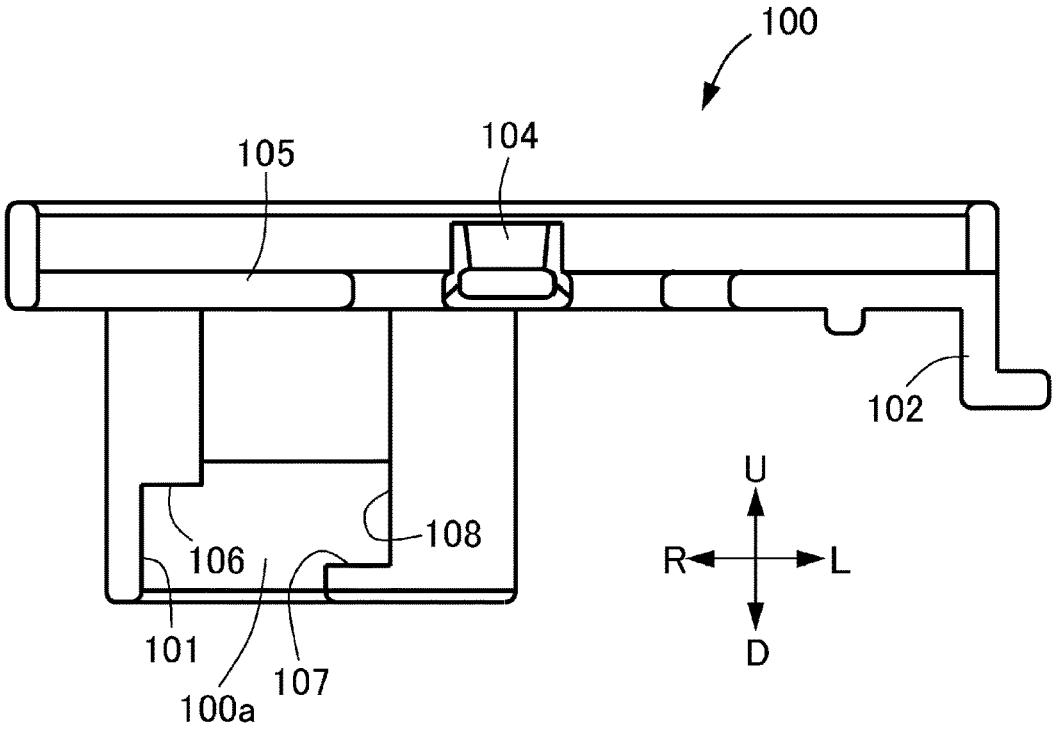

Parts (a) and (b) of FIG. 8 are schematic views showing the fixing member of the fixing device according to the first embodiment, in which part (a) is a perspective view of the fixing member and part (b) is a front view of the fixing member.

Figure 9:
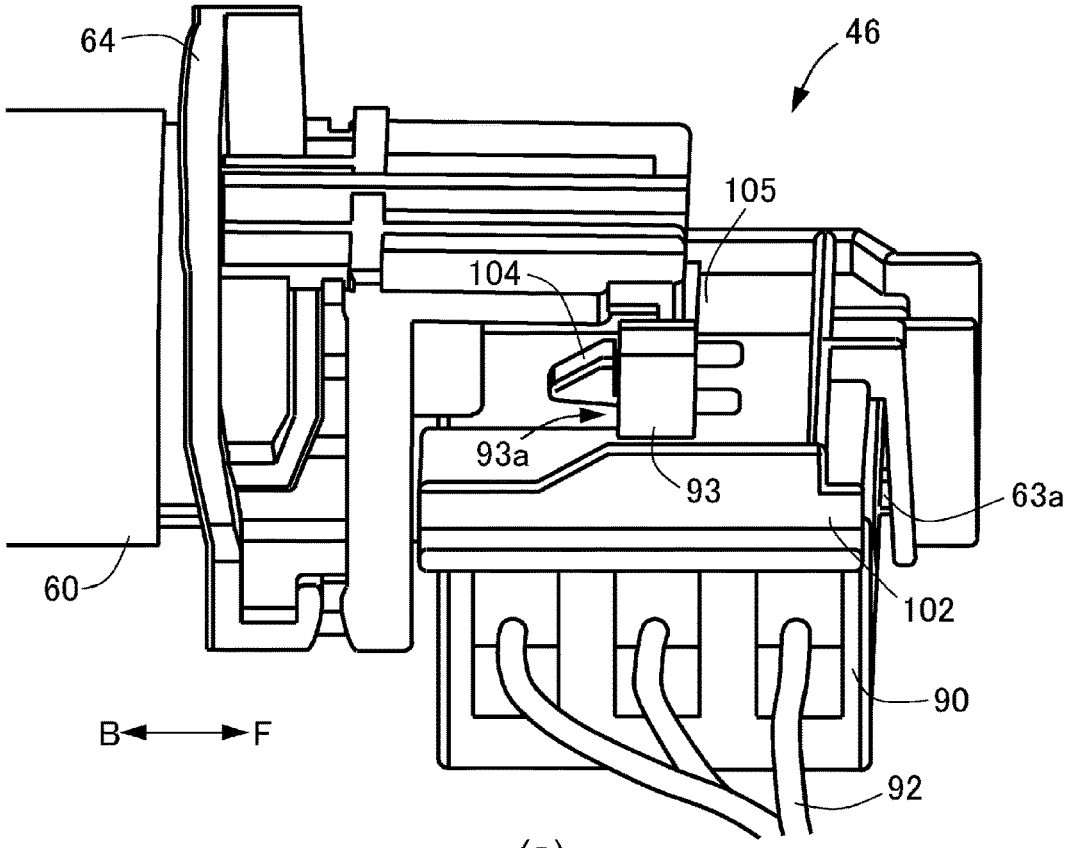
Figure 9:
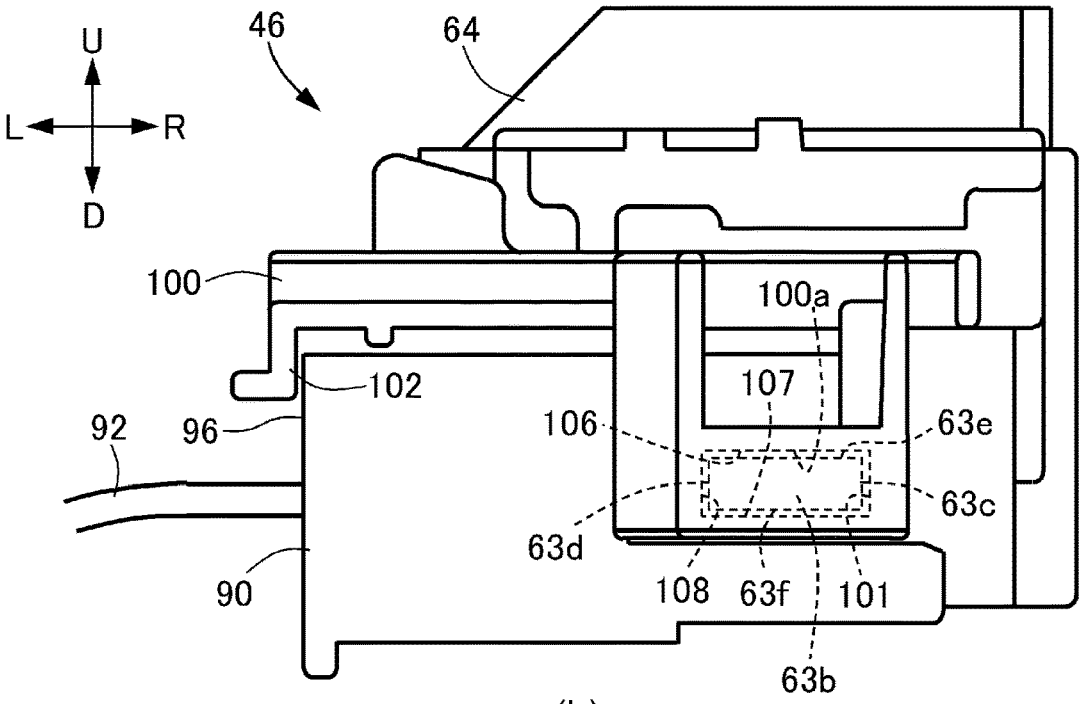

Parts (a) and (b) of FIG. 9 are schematic views showing a state in which the fixing member is mounted in the fixing device according to the first embodiment, in which part (a) is a perspective view showing the state and part (b) is front view showing the state.

Figure 10:
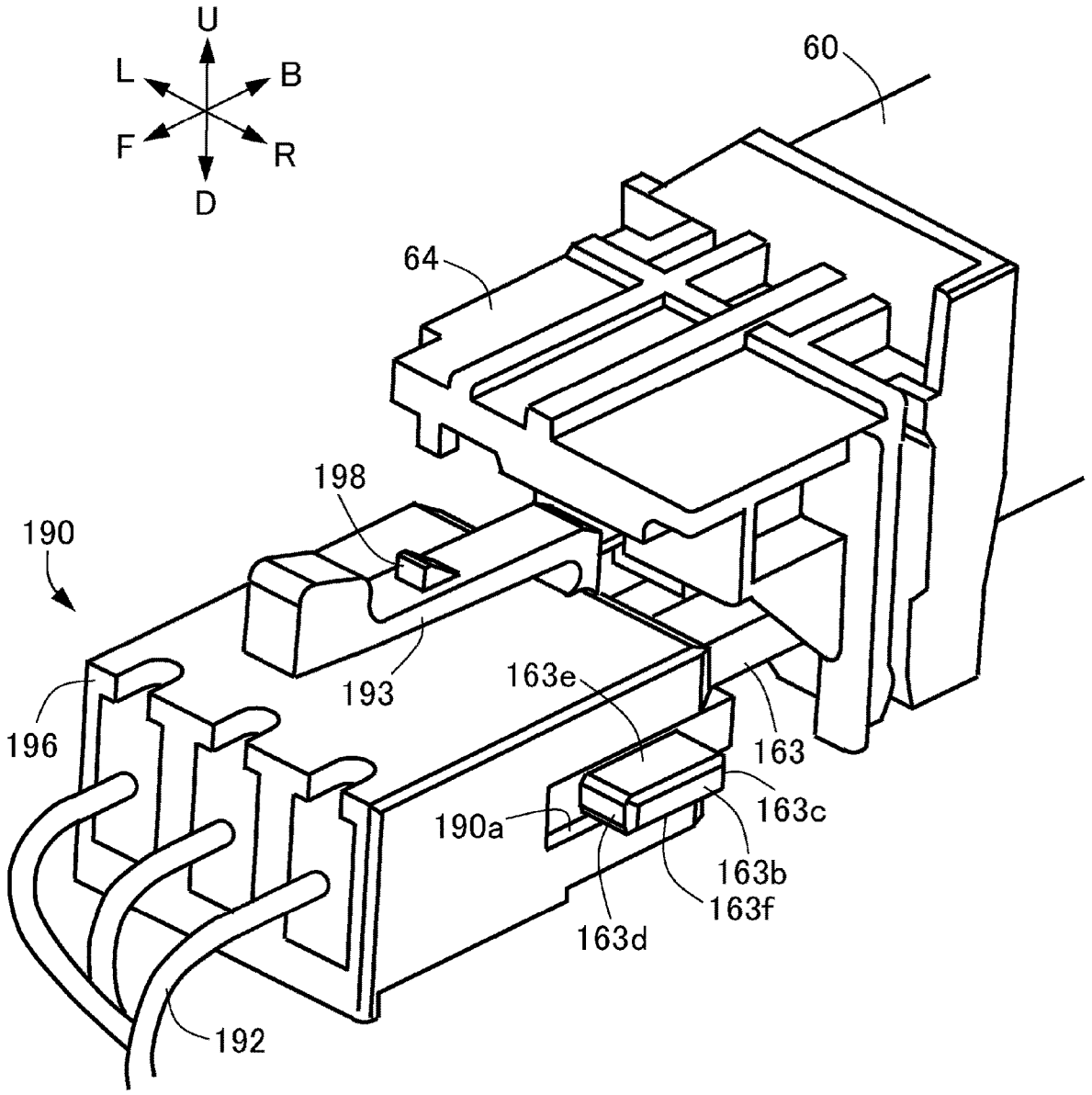

FIG. 10 is a perspective view showing a state in which a fixing member is not mounted in a fixing device according to a second embodiment.

Figure 11:
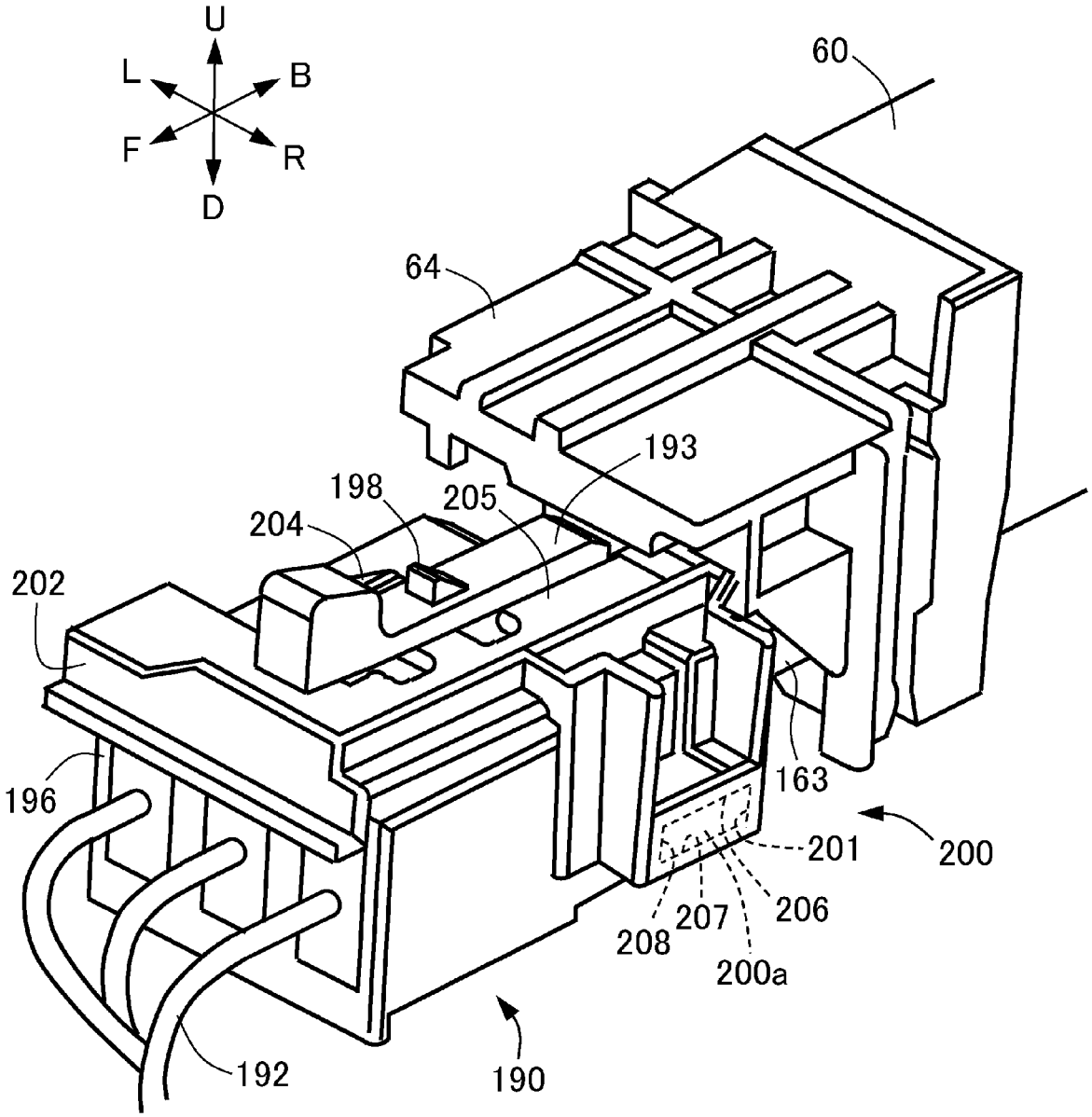

FIG. 11 is a perspective view showing a state in which the fixing member is mounted in the fixing device according to the second embodiment.

DESCRIPTION OF EMBODIMENTS

First Embodiment

In the following, a first embodiment of the present invention will be specifically described with reference to FIG. 1 to part (b) of FIG. 9. In this embodiment, as the example of an image forming apparatus 1 in which a fixing device 46 is mounted, a full-color printer of a tandem type is described. However, the present invention is not limited to the image forming apparatus 1 of the tandem type in which a fixing device is mounted, but may also be an image forming apparatus of another type in which the fixing device is mounted. Further, the image forming apparatus 1 is not limited to the full-color image forming apparatus, but may also be a monochromatic image forming apparatus or a single-color image forming apparatus. Or, the image forming apparatus 1 can be carried out in various uses such as printers, various printing machines, copying machines, facsimile machines and multi-function machines.

Figure 1:
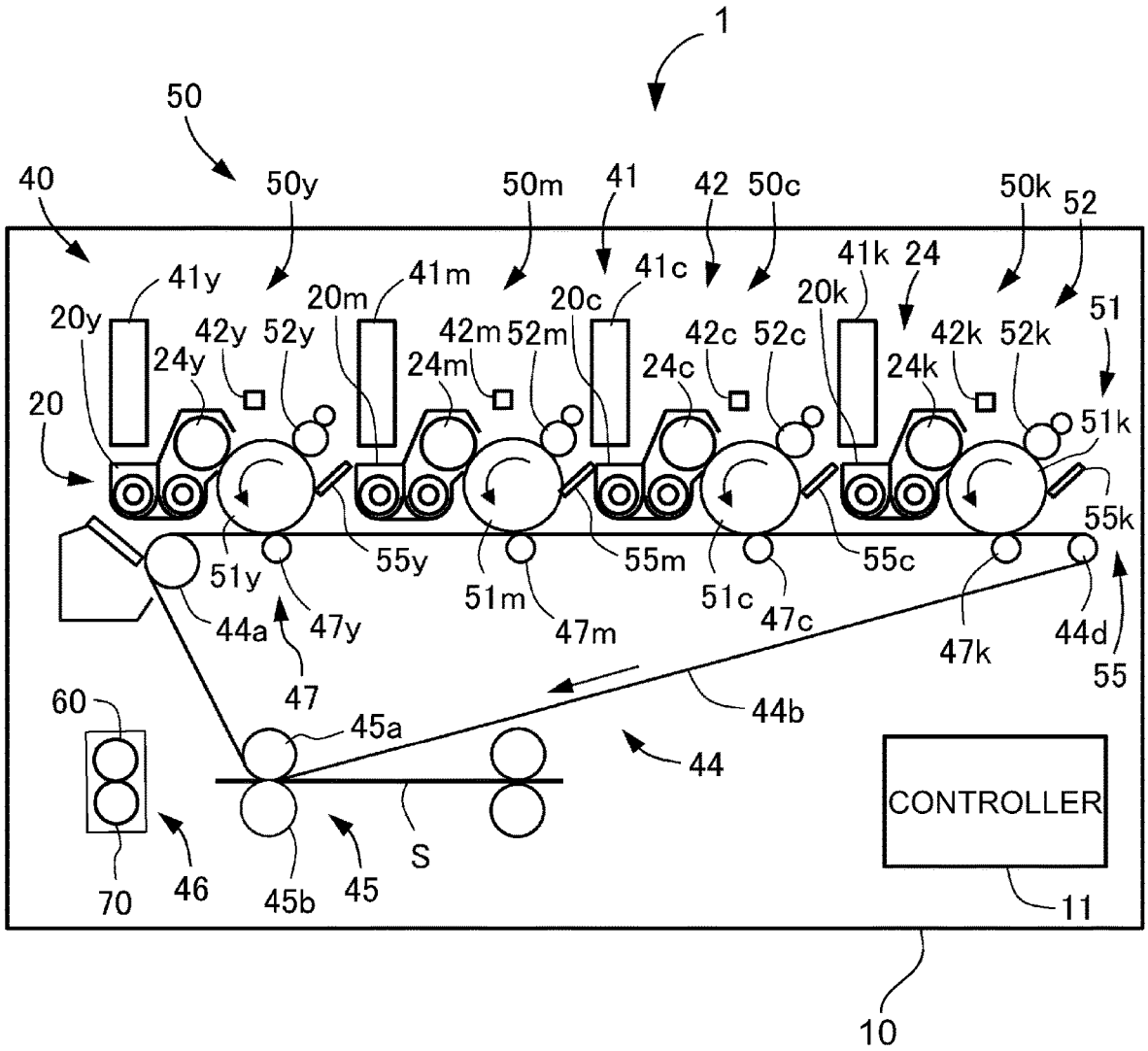
FIG. 1 is a sectional view showing a schematic structure of an image forming apparatus according to a first embodiment.

As shown in FIG. 1, the image forming apparatus 1 includes an apparatus main assembly 10, an unshown sheet feeding portion, an image forming portion 40, a controller 11 and an unshown operating portion. The image forming apparatus 1 is capable of forming a four-color-based full-color image on a recording material depending on an image signal from a host device such as an original reading device or a personal computer or from an unshown external device such as a digital camera or a smartphone. Incidentally, in this embodiment, as regards the apparatus main assembly 10, illustration is made in such a manner that a front (surface) side is a front side F, a rear (surface) side is a back side B, a right-hand side is a right side R, a left-hand side is a left side L, an upper side is an upside U, and a lower side is a downside D. Further, on a sheet S which is the recording material, a toner image is to be formed, and specific examples of the sheet S include plain paper, a synthetic resin sheet as a substitute for the plain paper, thick paper, a sheet for an overhead projector, and the like.

[Image Forming Portion]

The image forming portion 40 is capable of forming an image, on the basis of image information on the sheet S fed from the sheet feeding portion. The image forming portion 40 includes image forming units 50*y*, 50*m*, 50*c* and 50*k*, toner bottles 41*y*, 41*m*, 41*c* and 41*k*, exposure devices 42*y*, 42*m*, 42*c* and 42*k*, an intermediary transfer unit 44, a secondary transfer portion 45 and a fixing device 46. Incidentally, the image forming apparatus 1 of this embodiment is capable of forming a full-color image and includes the image forming units 50*y* for yellow (y), 50*m* for magenta (m), 50*c* for cyan (c) and 50*k* for black (k), which have the same constitution and which are provided separately. For this reason, in FIG. 1, respective constituent elements for four colors are shown by adding associated color identifiers to associated reference numerals, but in the specification, the constituent elements are described using only the reference numerals without adding the color identifies in some cases.

The image forming unit 50 includes a photosensitive drum 51 movable while carrying a toner image, a charging roller 52, a developing device 20 and a cleaning blade 55. The image forming unit 50 is integrally assembled into a unit as a process cartridge and is constituted so as to be mountable and dismountable from the apparatus main assembly 10, so that the image forming unit 50 forms the toner image on an intermediary transfer belt 44*b* described later.

The photosensitive drum 51 is rotatable and carries an electrostatic image used for image formation. In this embodiment, the photosensitive drum 51 is a negatively chargeable organic photoconductor (OPC) of 30 mm in outer diameter and is rotationally driven at a predetermined process speed (peripheral speed) in an arrow direction by an unshown motor. As each of the charging rollers 52*y*, 52*m*, 52*c* and 52*k*, a rubber roller rotated by the photosensitive drum 51 in contact with a surface of the photosensitive drum 51 is used and electrically charges the surface of the photosensitive drum 51 uniformly. The exposure device 42 is a laser scanner and emits laser light in accordance with image information of separated color outputted from the controller 11.

The developing devices 20*y*, 20*m*, 20*c* and 20*k* include developing sleeves 24*y*, 24*m*, 24*c* and 24*k*, respectively, and each of the developing devices 20 develops, with toner, the electrostatic image formed on the photosensitive drum 51 by applying thereto a developing bias. The developing device 20 not only accommodates the developer supplied from a toner bottle 41 but also develops the electrostatic image formed on the photosensitive drum 51. The developing sleeve 24 is constituted by a non-magnetic material, for example, aluminum, non-magnetic stainless steel or the like, and is made of aluminum in this embodiment. Inside the developing sleeve 24, a roller-shaped magnet roller is fixedly provided in a non-rotatable state relative to a developer container. The developing sleeve 24 carries a developer including non-magnetic toner and a magnetic carrier and feeds the developer to a developing region opposing the photosensitive drum 51.

The toner image formed on the surface of the photosensitive drum 51 is primary-transferred onto the intermediary transfer unit 44. Cleaning blades 55*y*, 55*m*, 55*c* and 55*k* are of a counter blade type and are contacted to the photosensitive drums 51*y*, 51*m*, 51*c* and 51*k*, respectively, with predetermined pressing forces. After the primary transfer, the toner remaining on the photosensitive drum 51 without being transferred onto the intermediary transfer unit 44 is removed by the cleaning blade 55 provided in contact with the photosensitive drum 51, and then the photosensitive drum 51 prepares for a subsequent image forming process.

The intermediary transfer unit 44 includes a plurality of rollers including a driving roller 44*a*, a follower roller 44*d* and the primary transfer rollers 47*y*, 47*m*, 47*c* and 47*k* and includes the intermediary transfer belt 44*b* wound around these rollers and moving while carrying the toner images. The follower roller 44*d* is a tension roller for controlling tension of the intermediary transfer belt 44*b* at a constant value. To the follower roller 44*d*, a force such that the intermediary transfer belt 44*b* is pushed toward the surface side by an urging force of an unshown urging spring. The primary transfer rollers 47*y*, 47*m*, 47*c* and 47*k* are disposed opposed to the photosensitive drums 51*y*, 51*m*, 51*c* and 51*k*, respectively, and contact the intermediary transfer belt 44*b*, so that the primary transfer rollers 47 primary-transfer the toner images from the photosensitive drums 51 onto the intermediary transfer belt 44*b*.

The intermediary transfer belt 44*b* contacts the photosensitive drum 51 and forms a primary transfer portion between itself and the photosensitive drum 51, and primary-transfers the toner image, formed on the photosensitive drum 51, at the primary transfer portion by being supplied with a primary transfer bias. By applying a positive primary transfer bias to the intermediary transfer belt 44*b* through the primary transfer rollers 47, negative toner images on the photosensitive drums 51 are multiple-transferred successively onto the intermediary transfer belt 44*b*.

The secondary transfer portion 45 includes an inner secondary transfer roller 45*a* and an outer secondary transfer roller 45*b*. The outer secondary transfer roller 45*b* contacts the intermediary transfer belt 44*b*, and in a nip between itself and the intermediary transfer belt 44*b*, a secondary transfer bias of an opposite polarity to the charge polarity of the toner is applied to the outer secondary transfer roller 45*b*. As a result, the outer secondary transfer roller 45*b*, collectively secondary-transfers the toner images from the intermediary transfer belt 44*b* onto the sheet S supplied to the nip.

The fixing device 46 includes a fixing film belt 60 and a pressing roller 70. The sheet S is nipped and fed between the fixing belt 60 and the pressing roller 70 and is conveyed in a sheet feeding direction, whereby the toner image transferred and formed on the sheet S is heated and pressed and is fixed on the sheet S. A detailed structure of the fixing device 46 will be described later.

[Controller]

The controller 11 is constituted by a computer and includes, for example, a CPU, a ROM for storing a program for controlling the respective portions, a RAM for temporarily storing data, and an input/output circuit through which signals are inputted from and outputted into an external device. The CPU is a microprocessor for managing an entirety of control of the image forming apparatus 1 and is a main body of a system controller. The CPU is connected with a sheet feeding portion, the image forming portion and the like via the input/output circuit and not only transfers signals with the respective portions but also controls operations of the respective portions. In the ROM, an image forming control sequence for forming the image on the sheet S and the like are stored.

[Image Forming Operation]

Next, the image forming operation of the image forming apparatus 1 constituted as described above will be described. When the image forming operation is started, first, the photosensitive drum 51 is rotated and the surface thereof is electrically charged by the charging roller 52. Then, on the basis of the image information, the laser light is emitted from the exposure device 42 to the photosensitive drum 51, so that the electrostatic image is formed on the surface of the photosensitive drum 51. The toner is deposited on this electrostatic image, whereby the electrostatic image is developed and visualized as the toner image and then the toner image is transferred onto the intermediary transfer belt 44*b*.

On the other hand, the sheet S is fed in parallel to such a toner image forming operation and is conveyed to the secondary transfer portion 45 along a feeding path by being timed to the toner images on the intermediary transfer belt 44*b*. Then, the images are transferred from the intermediary transfer belt 44*b* onto the sheet S. The sheet S is conveyed to the fixing device 46, in which the unfixed toner image is heated and pressed and thus is fixed on the surface of the sheet S, and then the sheet S is discharged from the apparatus main assembly 10.

[Fixing Device (Image Heating Apparatus)]

Figure 2:
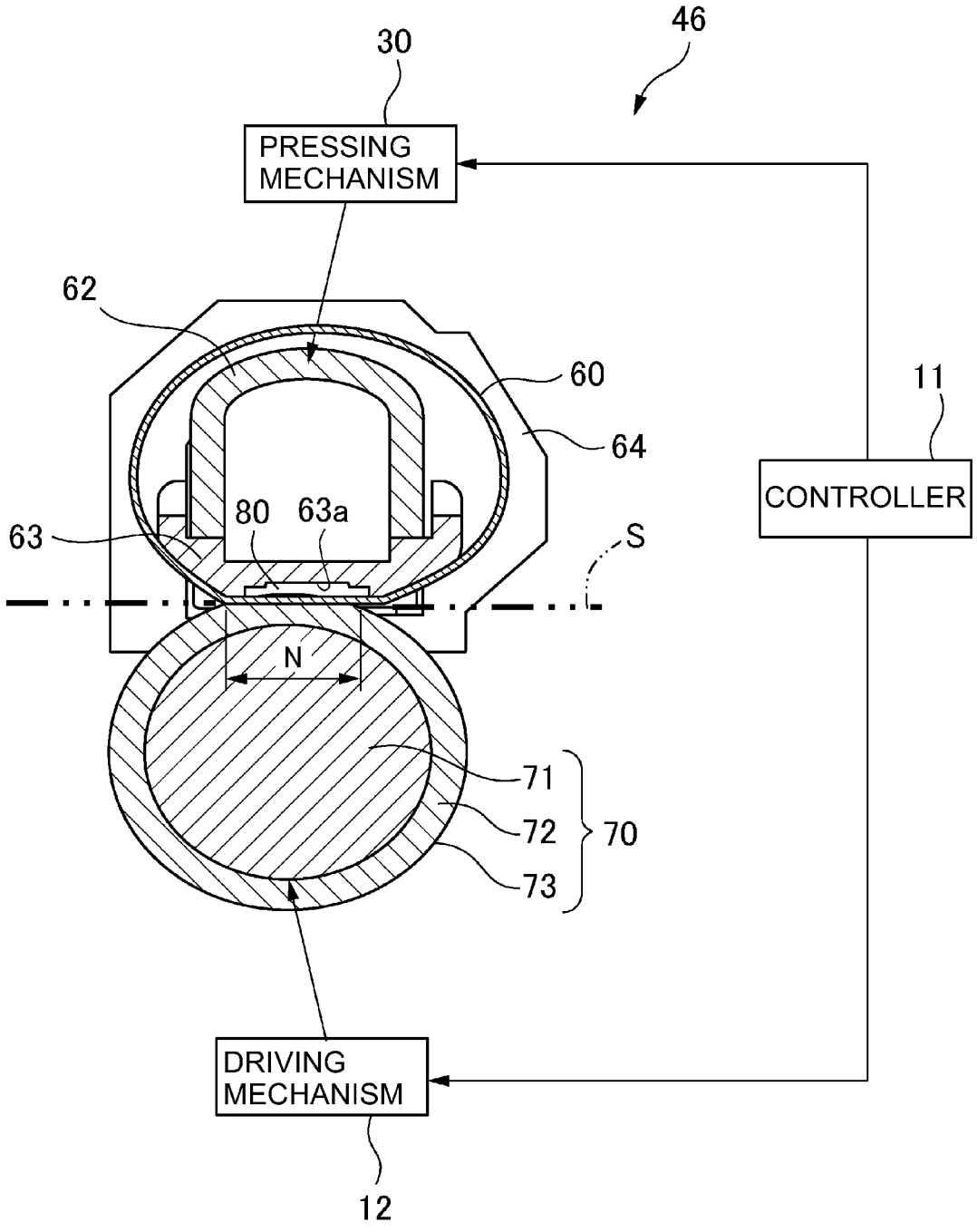
FIG. 2 is a sectional view showing a fixing device according to the first embodiment.

Next, a constitution of the fixing device (image heating apparatus) 46 will be described specifically. FIG. 2*s* an illustration of a structure of the fixing device 46. Parts (a) and (b) of FIG. 3 are illustrations of a structure of a ceramic heater 80. FIG. 4 is an illustration of an arrangement of fixing flanges 64. As shown in FIG. 2, the fixing device 46 includes the fixing belt 60 which is a rotatable endless belt, the fixing flanges 64 holding both end portions of the fixing belt 60, the ceramic heater 80, a guiding member 63, and the pressing roller 70. In this embodiment, rotation axis directions (longitudinal directions) of the fixing belt 60 and the pressing roller 70 are a front-rear (back) direction of the apparatus main assembly. Further, a connector 90 (see FIG. 6) is provided at an end portion of the fixing belt 60 on the front side F.

The fixing belt (fixing film) 60 rotates in contact with an image surface of the sheet S. The fixing flanges 64 which are an example of a supporting member rotatable supports the both end portions of the fixing belt 60 with respect to the rotation axis direction. The guiding member 63 not only holds the ceramic heater 80 which is an example of a heating member but also guides rotation of the fixing belt 80. The pressing roller 70 which is an example of a rotatable member is press-contacted to the fixing belt 60 toward the ceramic heater 80, so that a nip N in which the sheet S carrying thereon the toner image is nipped and fed between the pressing roller 70 and the fixing belt 60 is formed. The ceramic heater 80 includes a plurality of electrodes 85, 86 and 87 at an end portion projecting from the fixing flange 64 in the rotation axis direction of the fixing belt 60. The ceramic heater 80 is energized through the plurality of electrodes 85, 86 and 87 and generates heat, and heats the image surface of the sheet S through the fixing belt 60.

The fixing device 46 of a belt heating type forms the nip N by interposing the fixing belt 60 between the ceramic heater 80 and the pressing roller 70. The fixing flanges 64 are pressed toward the pressing roller 70. The fixing flanges 64 are pressed toward the pressing roller 70 by a pressing mechanism (see FIG. 4). This pressing direction is an up-down direction including the up side U and the downside D. The fixing device 46 introduces the sheet S, carrying thereon the unfixed toner image, into the nip N, and nips and feeds the fixing belt 60 in a cooperation with the fixing belt 60. The fixing device 46 causes pressure of the nip N to act on the unfixed toner image while applying heat of the ceramic heater 80 to the unfixed toner image through the fixing belt 60, and thus fixes the unfixed toner image on the sheet S.

[Fixing Belt]

The fixing belt 60 is rotated by rotation of the pressing roller 70. The fixing belt 60 is a cylindrical heat-resistant belt member as a heat generating member for conducting heat to the sheet S. The fixing belt 60 is loosely fitted around the guiding member 63. The fixing belt 60 is a single layer endless belt of a fluorine-containing resin material, such as PTFE, PFA or FEP, and has an outer diameter of 30 mm and a thickness of 100 μm or less, preferably 20 μm or more and 50 μm or less. Or, the fixing belt 60 is a composite-layer endless belt. It is also possible to employ an endless belt made of metal.

The fixing belt 60 is thin and small in thermal capacity and has a good thermal responsivity, and therefore, thermal response of the ceramic heater 80 can be reflected in the nip N as it is. For this reason, a temperature reaches a fixing temperature in a short time from energization to the ceramic heater 80, and therefore, electric power saving is realized.

[Pressing Roller]

The pressing roller 70 is driven by a driving mechanism 12 and is rotated at a peripheral speed which is substantially same as a feeding speed of the sheet S on which the toner image fed from the secondary transfer portion 45 (see FIG. 1) is carried. An outer diameter of the pressing roller 70 is 25 mm. The pressing roller 70 includes a shaft member 71 formed of an aluminum cylindrical material of 20 mm in outer diameter and 1.3 mm in thickness and includes a 2.5 mm-thick elastic layer 72 formed, on the shaft member 71, of a soft silicone rubber of 64° in ASKER hardness. The surface of the elastic layer 72 is coated with a 50 μm-thick parting layer 73 of a PFA tube.

The pressing roller 70 further includes unshown bearing members which are mounted on both end portions of the shaft member 71 and which are formed of a heat-resistant resin material such as PEEK, PPS, a liquid crystal polymer or the like. As a material of the parting layer 73, it is desirable that a material, excellent in parting property and heat-resistant property, such as a fluorine-containing resin, a silicone resin, a fluorosilicone rubber, a fluorine-containing rubber, a silicone rubber, PFA, PTFE, FEP or the like is used.

[Ceramic Heater]

The ceramic heater 80 is provided on an inner peripheral side of the fixing belt 60 and heats the fixing belt 60. As shown in parts (a) and (b) of FIG. 3, the ceramic heater 80 is increased in temperature by heat generation of heat generating resistors 82 and 83 to which electric power is supplied. As regards the ceramic heater 80, the heat generating resistors 82 and 83 are formed by printing Ag—Pd paste on a ceramic substrate ($Al_2O_3$) 81 in a thick layer (film) and then by baking the paste, and surfaces of the heat generating resistors 82 and 83 are sealed with a glass protective layer 84.

The heat generating resistors 82 and 83 are formed so that heat generation distributions thereof are different from each other. The heat generating resistors 82 are main heaters, and two heat generating resistors are disposed along a center line and are formed so that each of heat generating resistor layers is thin at a central portion and thick at end portions so as to increase a heat generation amount at the longitudinal central portion. The heat generating resistors 83 and sub-heaters, and two heat generating resistors are disposed outside the heat generating resistors 82 so that each of heat generating resistor layers is thick at a central portion and thin at end portions so as to increase a heat generation amount at the end portions. A combined heat generation amount of the heat generation amount of the heat generating resistors 82 and the heat generation amount of the heat generating resistors 83 is substantially constant along the rotation axis direction. The electrode 85 is electrically conducted to the heat generating resistor 83. The electrode 86 is electrically conducted to the heat generating resistor 82. The electrode 87 is electrically conducted to the heat generating resistor 82 and the heat generating resistor 83 in common.

[Guiding Member]

As shown in FIG. 2, the guiding member 63 as a holding member performs positioning and holding of the ceramic heater 80. The ceramic heater 80 is engaged in and supported by an engaging groove 63*a* formed on a lower surface of the guiding member 63. The guiding member 63 performs functions of back-up of the fixing belt 60, pressure application of the nip N formed by press-contact of the fixing belt 60 to the pressing roller 70 and feeding stability of the fixing belt 60 during rotation.

The guiding member 63 is disposed so as to penetrate along the rotation axis direction of the fixing belt 60 and slides on an inner surface of the fixing belt 60. The guiding member 63 is formed in a beam shape with a synthetic resin material having a heat-resistant property, a low friction coefficient and a low thermal conductivity. Examples of the synthetic resin material include phenolic resin, polyimide resin, polyamide resin, polyamideimide resin, PEEK resin, PES resin, PPS resin, PFA resin, PTFE resin, and LCP resin.

The ceramic heater 80 supported by the guiding member 63 is urged toward the pressing roller 70 while sandwiching the fixing belt 60 therebetween. The ceramic heater 80 and the guiding member 63 are urged together toward the pressing roller 70, so that the nip N is formed between the fixing belt 60 and the pressing roller 70 and the sheet S is fed through the nip N. Hereinafter, a direction in which the sheet S is fed is referred to as a feeding direction.

A stay 62 supports an entirety of the guiding member 63 with respect to a longitudinal direction at an inside of the fixing belt 60 and urges the guiding member 63 toward the pressing roller 70. The stay 62 ensures strength of the guiding member 63. The stay 62 is formed in a beam shape with a steel material having a U-shape in cross-section. The stay 62 is pressed against a back surface of a relatively soft guiding member 63 and imparts longitudinal strength to the guiding member 63, and rectifies a flexure shape of the guiding member 63.

As shown in FIG. 4, the fixing flanges 64 are engaged with and held by unshown side plates of the fixing device 46. The fixing flanges 64 are engaged with the stay 62 (see FIG. 2) at both end portions of the stay 62 and not only guide rotation of the fixing belt 60 but also prevent disconnection (falling-off) of the fixing belt 60 by restricting the end portions of the fixing belt 60.

[Pressing Mount]

The pressing mechanism 30 is provided on each of a pair of fixing flanges 64 shown in FIG. 4, and the pressing mechanisms 30 have the same structure. Each of the pressing mechanisms 30 presses the associated fixing flange 64 toward the pressing roller 70 in a downside D. The pressing mechanism 30 is switched between a pressed (pressure-applied) state (see part (a) of FIG. 5) and a pressure-released state (see part (b) of FIG. 5). Incidentally, in this embodiment, the pressing mechanisms 30, the fixing flanges 64 and the stay 62 are collectively referred to as a pressing means, and the pressing means causes the fixing belt 60 and the pressing roller 70 to press-contact each other. In the following, the switching of the state of the pressing mechanisms 30 will be described using parts (a) and (b) of FIG. 5.

As shown in part (a) of FIG. 5, a pressing lever 33 is rotatable about a supporting shaft as a fulcrum, and a rotation and thereof is pressed by a screw 34 provided with a pressing spring, so that the pressing lever 33 presses a portion-to-be-pressed 64*b* of the associated fixing flange 64. The screw 34 provided with the pressing spring is fixed by a pressing screw fixing portion 35. When a motor 37 rotates a driving shaft 31, an eccentric cam 32 rotates about the driving shaft 31, so that the eccentric cam 32 raised and lowers the rotation end of the pressing lever 33. The pressing mechanism 30 releases pushing-up of the pressing lever 33 by the eccentric cam 32 and thus presses the fixing belt 60 toward the downside D, so that the nip N (see FIG. 2) of the sheet S is formed between the fixing belt 60 and the pressing roller 70. The eccentric cam 32 rotates, whereby the pressing lever 33 operates in a direction in which the pressing lever 33 press-contacts the portion-to-be-pressed 64*b* of the fixing flange 64, so that a pressed state in which a pressure μl is applied between the fixing belt 60 and the pressing roller 70 is formed.

As shown in part (a) of FIG. 5, the pressing mechanism 30 release the pressure application to the fixing belt 60 by pushing up the pressing lever 33 by the eccentric cam 32, so that the fixing belt 60 is separated (spaced) from the pressing roller 70. The eccentric cam 32 rotates, whereby the pressing lever 33 operates in a direction in which the pressing lever 33 is separated from the portion-to-be-pressed 64*b* of the fixing flange 64, so that the pressure-released state in which the pressure is not applied between the fixing belt 60 and the pressing roller 70 is formed. The release of the pressure application aims at relaxing a drawing force of a jammed sheet S during jam clearance and preventing deformation of the fixing belt 60 during main switch off or during a sleep mode, and the like.

[Connector]

As shown FIG. 6, at a portion where the ceramic heater 80 and the guiding member 63 project from the fixing flange 64 toward a front side F (see FIG. 4) in the rotation axis direction of the fixing belt 60, the connector 90 is mounted so that a right side (first direction) R is a mounting direction. That is, the connector 90 is mounted to the end portions of the front side R of the ceramic heater 80 and the guiding member 63 in the mounting direction toward the right side R, so that a current can be supplied to the ceramic heater 80. In this embodiment, a first direction is a direction crossing the rotation axis direction, i.e., a direction toward the right-side roller with respect to a left-right direction.

The ceramic heater 80 is held by being engaged in an engaging groove 63*a* formed on a lower surface of the guiding member 63. An overlapping portion between the ceramic heater 80 and the guiding member 63 is sandwiched by a U-shaped connector 90 from the up side U and the downside D, so that the connector 90 is mounted. When the ceramic heater 80 is engaged in the engaging groove 63*a* provided on the lower surface of the guiding member 63 and then the connector 90 is mounted, energization terminals 91 in the connector 90 and the electrodes 85, 86 and 87 (see part (a) of FIG. 3) electrically each other. The energization terminals 91 provided on the connector 90 in a spring shape and the electrodes 85, 86 and 87 of the ceramic heater 80 electrically contact each other, so that energization to the ceramic heater 80 is carried out from an unshown voltage (power) source. An urging spring 97 provided in the connector 90 urges the ceramic heater 80 toward the energization terminals 91 in the direction of the downside D.

The energization terminals 91 provided on the connector 90 is fixed at one end thereof to an inner surface of the connector 90 while having a spring shape and are elastically raised and lowered at contact portions on the other end side. The energization terminals 91 is molded with a metal material having a spring property. A fixed end of the energization terminals 91 is connected to wiring 92 on an inside of a housing member 94 of the connector 90. The to housing member 94 of the connector 90 is formed of a resin material, such as the LCP, excellent in insulating property and heat-resistant property, and holds the energization terminals 91.

As shown in FIG. 7, at an end portion of the guiding member 63 on the front side F, a projection (projected portion) 63*b* projecting in the direction of the front side F is provided. The projection 63*b* enters a groove portion 90*a* formed on a side wall of the connector 90 on the front side F and projects toward the front side F than the connector 90. Incidentally, the projection 63*b* includes an engaging surface 63*c* facing the right side R, an engaging surface 63*d* facing the left side L, an engaging surface 63*e* facing the upside U and an engaging surface 63*f* facing the downside D.

The connector 90 includes an arm portion 93 provided on an upper surface of the housing member 94. The arm portion 93 is supported by the housing member 94 at a base portion 95 thereof connected to the housing member 94 at an end portion of the right side R of the housing member 94, and the left side of the arm portion 93 is a free end, so that the arm portion 93 is elastically deformable in the up-down direction and the like. The arm portion 93 includes a projection (third portion-to-be-engaged) 98 formed so as to project toward the up side U and an engaging surface (fourth portion-to-be-engaged) 93*a* (see part (a) of FIG. 9) which is a surface on the back side B. The projection 98 is formed integrally with the fixing flange 64 and engages toward the left side L with a third engaging portion 64*a* projecting toward the downside D. By this, the projection 98 not only engages with the third engaging portion 64*a* of the fixing flange 64 but also restricts movement of the connector 90 toward the left side L.

Here, in the fixing device 46, by engagement between the projection 98 of the arm portion 93 of the connector 90 and the third engaging portion 64*a* of the fixing flange 64, disconnection of the connector 90 toward the left side L is prevented. However, for example, by the pressure application by the pressing mechanism 30, a position of the connector 90 is displaced toward the downside D due to flexure and twist of the ceramic heater 80 and the guiding member 63 in some cases. In this case, there is a liability that the projection 98 of the arm portion 93 of the connector 90 is disconnected (disengaged) from the third engaging portion 64*a* of the fixing flange 64. Therefore, in this embodiment, by utilizing a fixing member 100 (see FIG. 8), the connector 90 and the guiding member 63 are fixed to each other. Further, by mounting the fixing member 100 to the connector 90 and the guiding member 63, even when the position of the connector 90 is displaced by flexure and twist of the guiding member 63, the fixing member 100, the connector 90, the guiding member 63, and the ceramic heater 80 produce the same motion. By this, even when the projection 98 of the arm portion 93 of the connector 90 has been disconnected from the third engaging portion 64*a* of the fixing flange 64, by using the fixing member 100, disconnection (falling-off) of the connector 90 from the guiding member 63 is prevented. In the following, the fixing member 100 will be described in detail.

[Fixing Member]

In this embodiment, the fixing member 100 is mounted to the connector 90 and the guiding member 63. The fixing member 100 is mounted to the connector 90 and the guiding member 63 in the direction of the back side (second direction) B which is the mounting direction, and fixes the connector 90 in a mounted state to end portions of the ceramic heater 80 and the guiding member 63. In this embodiment, the second direction is the rotation axis direction, i.e., the direction toward the back side B with respect to the front-back (rear) direction. As shown in part (a) of FIG. 8 to part (b) of FIG. 9, the fixing member 100 includes a first engaging portion 101, a second engaging portion 102, a third engaging portion 103, a fourth engaging portion 104, a fifth engaging portion 105, a sixth engaging portion 106, a seventh engaging portion 107, and an eighth engaging portion 108.

The first engaging portion 101 is an engaging surface formed by a wall portion of the fixing member 100 on the right side R and facing the left side L, and not only engages with the engaging surface (first portion-to-be-engaged) 63*c* of the guiding member 63 (see FIG. 7) but also restricts movement of the fixing member 100 toward the left side (opposite direction to the first direction) L. In this embodiment, the engaging surface 63*c* of the guiding member 63 is formed on the projection 63*b* projecting toward the front side F than the connector 90. Further, the first engaging portion 101 of the fixing member 100 is formed as a part of a recessed portion 100*a* with which the projection 63*b* engages.

The eighth engaging portion 108 is formed by the wall portion forming the left side L of the recessed portion 100*a* of the fixing member 100 and is a part of the recessed portion 100*a*, and is an engaging surface facing the right side R. The eighth engaging portion 108 not only engages with the engaging surface 63*d* (see FIG. 7) of the guiding member 63 but also restricts movement of the fixing member 100 toward the right side R. By these first and eighth engaging portions 101 and 108, the fixing member 100 is restricted in disconnection (falling-off) by movement in the left-right direction.

The second engaging portion 102 is an engaging surface formed by a wall portion of the fixing member 100 on the left side L and facing the right side R, and not only engages with an end portion (second portion-to-be-engaged) 96 of the connector 90 on the left side L but also restricts movement of the connector 90 toward the left side L. The second engaging portion 102 of the fixing member 100 is an opposing portion to the end portion 96 of the connector 90 with respect to the left-right direction. By these first and second engaging portions 101 and 102, the connector 90 is restricted in disconnection from the guiding member 63.

The fourth engaging portion 104 is a claw-shaped portion not only extending toward the back side B but also projecting toward the up side U, and not only engages with the engaging surface 93*a* of the arm portion 93 of the connector 90 but also restricts movement of the fixing member 100 toward the front side (opposite direction to the second direction) F. The fifth engaging portion 105 is provided adjacent to the right side R of the fourth engaging portion 104 and is disposed so as to face the back side B, and not only contacts the surface of the arm portion 93 of the connector 90 on the front side F but also restricts movement of the fixing member 100 toward the back side B. By these engaging portions 104 and 105, the fixing member 100 is restricted in disconnection by movement thereof in the front-back direction.

The sixth engaging portion 106 is formed by a wall portion of the fixing member 100 on the right side R and is a part of the recessed portion 100*a*, and is an engaging surface facing the downside D. The sixth engaging portion 106 not only engages with the engaging surface 63*e* of the guiding member 63 (see FIG. 7) but also restricts movement of the fixing member 100 toward the downside D.

The seventh engaging portion 107 is formed by the wall portion forming the left side L of the recessed portion 100*a* of the fixing member 100 and is a part of the recessed portion 100*a*, and is an engaging surface facing the up side U. The seventh engaging portion 107 not only engages with the engaging surface 63*f* (see FIG. 7) of the guiding member 63 but also restricts movement of the fixing member 100 toward the up side U. By these sixth and seventh engaging portions 106 and 107, the fixing member 100 is restricted in disconnection (falling-off) by movement in the up-down direction (the direction perpendicular to the left-right direction and the front-back direction). That is, the guiding member 63 restricts the movement of the fixing member 100 toward the up side U and the downside D by engagement of the recessed portion 100*a* of the fixing member 100 with the projection 63*b* of the guiding member 63.

As described above, according to the fixing device 46 of this embodiment, the fixing member 100 is not only fixed to the guiding member 63 with respect to the left-right direction and the up-down direction, but also restricts movement of the connector 90 toward the left side L. The fixing member 100 is held by the guiding member 63, and therefore, even when the position of the connector 90 is displaced by flexure and twist of the ceramic heater 80 and the guiding member 63, the fixing member 100, the connector 90, the guiding member 63 and the ceramic heater 80 produce the same motion. By this, even when the guiding member 63, the ceramic heater 80 and the connector 90 are displaced in the press-contact direction, it is possible to realize retention of the connector 90. That is, for example, even when a force in a direction in which the connector 90 is disengaged from the guiding member 63 acts on the wiring 92 of the connector 90, the connector 90 is restricted in position thereof with respect to the left-right direction by the fixing member 100, and therefore is not disconnected from the guiding member 63.

Further, in the fixing device 46 of this embodiment, the connector 90 not only includes the projection 98 on the arm portion 93 thereof but also engages with the third engaging portion 64*a* of the fixing flange 64. Here, there is a liability that for example, by the pressure application by the pressing mechanism 30, the position of the connector 90 is displaced toward the downside D due to flexure and twist of the ceramic heater 80 and the guiding member 63 and thus the projection 98 is disconnected from the third engaging portion 64*a*. On the other hand, according to the fixing device 46 of this embodiment, by using the fixing member 100, it is possible to prevent disconnection (disengagement) of the connector 90 from the guiding member 63.

Further, according to the fixing device 46 of this embodiment, the fixing member 100 includes the fourth engaging portion 104 and the fifth engaging portion 105 which engage with the arm portion 93 of the connector 90, so that it is possible to suppress disconnection of the fixing member 100 by movement of the fixing member 100 in the front-back direction.

Second Embodiment

Next, a second embodiment of the present invention will be specifically described with reference to FIGS. 10 and 11. This embodiment is different from the first embodiment in that the first direction which is the mounting direction of a connector 190 is the rotation axis direction, i.e., the front-back direction and that the second direction which is the mounting direction of a fixing member 200 is a direction crossing the rotation axis direction, i.e., the left-right direction. However, other constituent elements are similar to those in the first embodiment, and therefore, are represented by the same reference numerals or symbols and will be omitted from detailed description.

In this embodiment, as shown FIG. 10, at a portion where the ceramic heater 80 (see FIG. 6) and a guiding member 163 project from the fixing flange 64 toward a front side F in the rotation axis direction of the fixing belt 60, the connector 190 is mounted so that the back side (first direction) B is a mounting direction. That is, the connector 90 is mounted to the end portions of the front side R of the ceramic heater 80 and the guiding member 63 in the mounting direction toward the back side B, so that a current can be supplied to the ceramic heater 80. Other constituent elements of the connector 190 are similar to those of the first embodiment.

At an end portion of the guiding member 163 on the front side F, a projection (projected portion) 163*b* projecting in the direction of the right side R is provided. The projection 163*b* enters a groove portion 190*a* formed on a side wall of the connector 190 on the right side R and projects toward the right side R than the connector 190. Incidentally, the projection 163*b* includes an engaging surface 163*c* facing the back side B, an engaging surface 163*d* facing the front side F, an engaging surface 163*e* facing the up side U and an engaging surface 163*f* facing the downside D.

The connector 190 includes an arm portion 193 provided on an upper surface thereof. The arm portion 193 is elastically deformable in the up-down direction and the like. The arm portion 193 includes a projection (third portion-to-be-engaged) 198 formed so as to project toward the up side U and an engaging surface (fourth portion-to-be-engaged) which is a surface on the left side L. The projection 198 is formed integrally with the fixing flange 64 and engages toward the front side F with a third engaging portion 64*a* projecting toward the downside D. By this, the projection 198 not only engages with the third engaging portion 64*a* of the fixing flange 64 but also restricts movement of the connector 190 toward the front side F. Incidentally, the connector 190 is connected to a high-voltage source by wiring 192.

As shown in FIG. 11, the fixing member 200 is mounted to the connector 190 and the guiding member 163 in the direction of the left side (second direction) L which is the mounting direction, and fixes the connector 190 in a mounted state to end portions of the ceramic heater 80 (see FIG. 2) and the guiding member 163. In this embodiment, the second direction is a direction crossing the rotation axis direction, i.e., the direction toward the left side L with respect to the left-right direction. The fixing member 200 includes a first engaging portion 201, a second engaging portion 202, a third engaging portion 203, a fourth engaging portion 204, a fifth engaging portion 205, a sixth engaging portion 206, a seventh engaging portion 207, and an eighth engaging portion 208.

The first engaging portion 201 is an engaging surface formed by a wall portion of the fixing member 200 on the back side B and facing the front side F. The first engaging portion 201 not only engages with the engaging surface (first portion-to-be-engaged) 163*c* of the guiding member 163 (see FIG. 10) but also restricts movement of the fixing member 200 toward the front side (opposite direction to the first direction) F. In this embodiment, the engaging surface 163*c* of the guiding member 163 is formed on the projection 163*b* projecting toward the right side R than the connector 190. Further, the first engaging portion 201 of the fixing member 200 is formed as a part of a recessed portion 200*a* with which the projection 163*b* engages.

The eighth engaging portion 208 is formed by the wall portion forming the front side F of the recessed portion 200*a* of the fixing member 200 and is a part of the recessed portion 200*a*, and is an engaging surface facing the back side B. The eighth engaging portion 208 not only engages with the engaging surface 163*d* (see FIG. 10) of the guiding member 163 but also restricts movement of the fixing member 200 toward the back side B. By these first and eighth engaging portions 201 and 208, the fixing member 200 is restricted in disconnection (falling-off) by movement in the front-back direction.

The second engaging portion 202 is an engaging surface formed by a wall portion of the fixing member 200 on the front side F and facing the back side B, and not only engages with an end portion (second portion-to-be-engaged) 196 of the connector 190 on the left side L but also restricts movement of the connector 190 toward the front side F. The second engaging portion 202 of the fixing member 200 is an opposing portion to the end portion 196 of the connector 190 with respect to the front-back direction. By these first and second engaging portions 201 and 202, the connector 190 is restricted in disconnection from the guiding member 163.

The fourth engaging portion 204 is a claw-shaped portion not only extending toward the left side L but also projecting toward the up side U, and not only engages with a left side L engaging surface of the arm portion 193 of the connector 190 but also restricts movement of the fixing member 200 toward the right side (opposite direction to the second direction) R. The fifth engaging portion 205 is provided adjacent to the back side B of the fourth engaging portion 204 and is disposed so as to face the left side L, and not only contacts the surface of the arm portion 193 of the connector 190 on the right side R but also restricts movement of the fixing member 200 toward the left side L. By these engaging portions 204 and 205, the fixing member 200 is restricted in disconnection by movement thereof in the left-right direction.

The sixth engaging portion 206 is formed by a wall portion of the fixing member 200 on the right side R and is a part of the recessed portion 200*a*, and is an engaging surface facing the downside D. The sixth engaging portion 206 not only engages with the engaging surface 163*e* of the guiding member 163 (see FIG. 10) but also restricts movement of the fixing member 200 toward the downside D.

The seventh engaging portion 207 is formed by the wall portion forming the front side F of the recessed portion 200*a* of the fixing member 200 and is a part of the recessed portion 200*a*, and is an engaging surface facing the up side U. The seventh engaging portion 207 not only engages with the engaging surface 163*f* (see FIG. 10) of the guiding member 163 but also restricts movement of the fixing member 100 toward the up side U. By these sixth and seventh engaging portions 206 and 207, the fixing member 200 is restricted in disconnection (falling-off) by movement in the up-down direction. That is, the guiding member 163 restricts the movement of the fixing member 200 toward the up side U and the downside D by engagement of the recessed portion 200*a* of the fixing member 200 with the projection 163*b* of the guiding member 163.

As described above, according to the fixing device 46 of this embodiment, the fixing member 200 is not only fixed to the guiding member 163 with respect to the front-back direction and the up-down direction, but also restricts movement of the connector 190 toward the front side F. By this, even when the guiding member 163, the ceramic heater 80 and the connector 190 are displaced in the press-contact direction, it is possible to realize retention of the connector 190.

Further, according to the fixing device 46 of this embodiment, the present invention is applicable even when the fixing device 46 is such that the mounting direction of the connector 190 is the rotation axis direction and the mounting direction of the fixing member 200 is a direction crossing the rotation axis direction, so that an application range can be extended.

Incidentally, in the above-described embodiments, as the fixing device 46, those incorporated in the image forming apparatus 1 were described, but the present invention is not limited thereto. For example, the present invention is applicable to even when the fixing device is a single device (apparatus) which is installed and operated alone or a component unit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-078736 filed on Apr. 17, 2019, which is hereby incorporated by reference to herein in its entirety.

What is claimed is:

1. An image heating apparatus for heating an image on a recording material, comprising:

a rotatable endless belt;

a rotatable member configured to form a nip, between itself and said belt, in which the recording material on which a toner image is carried is nipped and fed;

a plate-like heater provided on an inner peripheral side of said belt and configured to heat said belt;

a holding member configured to hold said heater, wherein said holding member includes a first portion to be engaged;

a connector mounted to end portions of said heater and said holding member and capable of supplying a current to said heater, said connector being mountable to said heater and said holding member by being moved in a first direction, and said connector further being dismountable from said heater and said holding member by being moved in a direction opposite to the first direction, wherein said connector includes a second portion to be engaged; and a covering member provided in engagement with said connector and said holding member and configured to cover at least a part of said connector when viewed in the direction opposite to the first direction, wherein said covering member is mountable to said connector and said holding member by being moved in a second direction different from the first direction, and wherein said covering member further is dismountable from said connector and said holding member by being moved in a direction opposite to the second direction, wherein said covering member includes a first engaging portion configured to engage with said first portion to be engaged of said holding member and configured to restrict movement of said covering member in the direction opposite to the first direction and includes a second engaging portion configured to engage with said second portion to be engaged of said connector and configured to restrict movement of said connector in the direction opposite to the first direction, and wherein said covering member is mountable after said connector is mounted to said heater and said holding member, and said connector is dismountable after said covering member is dismounted from said holding member.

2. An image heating apparatus according to claim 1, further comprising a supporting member configured to rotatably support a longitudinal end portion of said belt, wherein said supporting member includes a third engaging portion, and wherein said connector includes a third portion to be engaged with which said third engaging portion of said supporting member engages and which is configured to restrict movement of said connector in the direction opposite to the first direction.

3. An image heating apparatus according to claim 1, further comprising a supporting member configured to rotatably support a longitudinal end portion of said belt, wherein said connector includes a fourth portion to be engaged, and wherein said covering member includes a fourth engaging portion configured to engage said fourth portion to be engaged of said connector and configured to restrict movement of said covering member in an opposite direction to the second direction.

4. An image heating apparatus according to claim 1, further comprising a supporting member configured to rotatably support a longitudinal end portion of said belt, wherein said supporting member includes a third engaging portion, wherein said connector includes a third portion to be engaged with which said third engaging portion of said supporting member engages and which is configured to restrict movement of said connector in the direction opposite to the first direction a fourth portion to be engaged, and an elastically deformable arm portion, wherein said covering member includes a fourth engaging portion configured to engage with said fourth portion to be engaged of said connector and configured to restrict movement of said covering member in the direction opposite to the second direction, and wherein said third portion to be engaged and said fourth portion to be engaged of said connector are formed on said arm portion.

5. An image forming apparatus according to claim 4, wherein said covering member includes a fifth engaging portion contacting said arm portion of said connector and configured to restrict movement of said covering member in the second direction.

6. An image heating apparatus according to claim 1, wherein said first portion to be engaged of said holding member is a projection projecting from said connector, and said first engaging portion of said covering member is a recessed portion with which said projection engages.

7. An image heating apparatus according to claim 6, wherein said holding member restricts movement of said covering member in a direction perpendicular to the first direction and the second direction by engagement of said recessed portion of said covering member with said projection of said holding member.

8. An image heating apparatus according to claim 1, wherein said second portion to be engaged of said connector is an end portion of said connector with respect to the direction opposite to the first direction, and said second engaging portion of said covering member is an opposing portion which opposes said end portion with respect to the first direction.

9. An image heating apparatus according to claim 1, wherein the first direction is a direction crossing a longitudinal direction of said belt, and the second direction is the longitudinal direction.

10. An image heating apparatus according to claim 1, wherein the first direction is a longitudinal direction of said belt, and the second direction is a direction crossing the longitudinal direction.

11. An image heating apparatus according to claim 1, wherein said heater contacts an inner surface of said belt, and the image on the recording material is fixed by using said belt heated by heat of said heater.

* * * * *